US012369714B2

(12) United States Patent
Isogai

(10) Patent No.: US 12,369,714 B2
(45) Date of Patent: Jul. 29, 2025

(54) CHAIR

(71) Applicant: OKAMURA CORPORATION, Yokohama (JP)

(72) Inventor: Yoshinori Isogai, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 144 days.

(21) Appl. No.: 18/034,041

(22) PCT Filed: Oct. 27, 2020

(86) PCT No.: PCT/JP2020/040238
§ 371 (c)(1),
(2) Date: Apr. 26, 2023

(87) PCT Pub. No.: WO2022/091214
PCT Pub. Date: May 5, 2022

(65) Prior Publication Data

US 2023/0380596 A1 Nov. 30, 2023

(51) Int. Cl.
*A47C 7/44* (2006.01)
*A47C 1/032* (2006.01)
(Continued)

(52) U.S. Cl.
CPC ..... *A47C 1/03238* (2013.01); *A47C 1/03255* (2013.01); *A47C 1/03277* (2013.01);
(Continued)

(58) Field of Classification Search
CPC ..... A47C 1/03277; A47C 7/44; A47C 7/443
(Continued)

(56) References Cited

U.S. PATENT DOCUMENTS 4,848,837 A 7/1989 Volkle
5,393,126 A * 2/1995 Boulva ..... A47C 5/06 297/452.56
(Continued)

FOREIGN PATENT DOCUMENTS

DE 8616836 U1 10/1987
DE 3635044 A1 * 4/1988 ..... A47C 1/03272
(Continued)

OTHER PUBLICATIONS

International Search Report for Application No. PCT/JP2020/040238, mailed Jan. 19, 2021 (5 pages).
(Continued)

*Primary Examiner* — Rodney B White
(74) *Attorney, Agent, or Firm* — NIXON PEABODY LLP; Jeffrey L. Costellia

(57) ABSTRACT

A chair of an aspect of the present disclosure includes: a support base; and a chair body including a seat frame that extends in the forward-rearward direction and forms at least part of a seat, and a back frame that is provided in the rear end of the seat frame to be pivotable around an axis O1 extending in the left-right direction, extends upward from the seat frame, and forms at least part of a backrest. The support base includes a slider that supports, in front of the axis O1, the seat frame movably in the forward-rearward direction, and a backrest-supporting shaft that supports, below the axis O1, the back frame pivotably around an axis O2 extending in the left-right direction.

4 Claims, 12 Drawing Sheets

(51) Int. Cl.
*A47C 3/30* (2006.01)
*A47C 7/00* (2006.01)

(52) U.S. Cl.
CPC ..... *A47C 1/03294* (2013.01); *A47C 3/30* (2013.01); *A47C 7/006* (2013.01); *A47C 7/44* (2013.01); *A47C 7/443* (2013.01)

(58) Field of Classification Search
USPC ..... 297/341, 452.56
See application file for complete search history.

(56) References Cited

U.S. PATENT DOCUMENTS

| | | | | |
|---|---|---|---|---|
| 6,113,186 | A * | 9/2000 | Holmes | A47C 11/005 297/452.56 |
| 7,425,039 | B2 * | 9/2008 | Lin | A47C 31/023 297/452.56 |
| 7,434,888 | B2 * | 10/2008 | Lin | A47C 7/282 297/452.56 X |
| 7,794,022 | B2 * | 9/2010 | Caruso | A47C 7/28 297/452.56 |
| 8,544,955 | B2 * | 10/2013 | Kim | A47C 1/03255 297/341 X |
| 8,752,896 | B2 * | 6/2014 | Takeuchi | A47C 1/03255 297/341 |
| 10,028,586 | B2 * | 7/2018 | Schneider | A47C 1/03238 |
| 10,780,003 | B2 * | 9/2020 | Beyer | A61G 5/122 |
| 10,820,703 | B2 * | 11/2020 | Maier | A47C 1/03277 |
| 10,966,527 | B2 * | 4/2021 | Deevers | A47C 3/12 |
| 11,134,780 | B2 * | 10/2021 | Maier | A47C 7/44 |
| 11,197,548 | B2 * | 12/2021 | Theesfeld | A47C 1/03255 |
| 11,259,637 | B2 * | 3/2022 | Ludwig | A47C 5/12 |
| 11,344,122 | B2 * | 5/2022 | Serena | A47C 7/285 |
| 11,357,329 | B2 * | 6/2022 | Deevers | A47C 7/38 |
| 11,471,345 | B2 * | 10/2022 | Beyer | A47C 9/005 |
| 11,812,870 | B2 * | 11/2023 | Deevers | A47C 1/03277 |
| 11,825,955 | B2 * | 11/2023 | Deevers | A47C 1/03277 |
| 2006/0138849 | A1 * | 6/2006 | Wilkerson | A47C 7/14 297/452.56 |
| 2007/0216213 | A1 * | 9/2007 | Chang | A47C 7/282 297/452.56 |
| 2008/0122284 | A1 * | 5/2008 | Yang | A47C 7/282 297/452.56 |
| 2008/0315661 | A1 * | 12/2008 | Lin | A47C 7/40 297/452.56 |
| 2009/0261644 | A1 * | 10/2009 | Piretti | A47C 7/44 297/344.12 |
| 2012/0161483 | A1 | 6/2012 | Hayashi | |
| 2013/0169017 | A1 * | 7/2013 | Masunaga | A47C 1/03255 297/320 |
| 2015/0223605 | A1 * | 8/2015 | Piretti | A47C 1/03255 297/341 |
| 2018/0332967 | A1 | 11/2018 | Jin et al. | |
| 2024/0138573 | A1 * | 5/2024 | Deevers | A47C 1/03279 |

FOREIGN PATENT DOCUMENTS

| | | |
|---|---|---|
| DE | 10 2017 010 337 A1 | 1/2019 |
| DE | 10 2019 000 249 A1 | 7/2020 |
| JP | A-63-186605 | 8/1988 |
| JP | A-2008-212622 | 9/2008 |
| JP | A-2012-135398 | 7/2012 |
| JP | A-2015-096162 | 5/2015 |
| JP | A-2018-533394 | 11/2018 |

OTHER PUBLICATIONS

European Search Report in European Patent App. No. EP 20959732.7, dated Jun. 21, 2024 (7 pages).

Japanese Office Action (Application No. 2022-558641); Mailed Feb. 4, 2025; pp. 5.

* cited by examiner

CHAIR

TECHNICAL FIELD

The present disclosure relates to a chair.

BACKGROUND ART

For example, in Patent Document 1 below, as a reclinable chair, a configuration is disclosed which includes a chair body in which a seat and a backrest are combined together, and a support structure that pivotably supports the chair body. In Patent Document 1 below, the front end portion of the seat is pivotably connected to the support structure. The lower end portion of the backrest is pivotably connected to the support structure. The seat and the backrest are pivotably connected to each other. In the chair of the type shown in Patent Document 1 below, as the backrest pivots rearward relative to the support structure, the backrest pivots relative to the seat, and the seat pivots relative to the support structure. Thereby, the backrest of the chair is reclined such that the front end portion of the seat moves up.

DOCUMENT OF RELATED ART

Patent Document

[Patent Document 1] Published Japanese Translation No. 2018-533394 of the PCT International Publication

SUMMARY OF THE INVENTION

Problems to be Solved by the Invention

However, in the above configuration in the related art, when the backrest is made to tilt (recline) while a person seats oneself in the chair, the seated person's thighs are pushed up by the front end portion of the seat. Therefore, the seated person may feel that the thighs are compressed and may feel discomfort.

An object of the present disclosure is to provide a chair that can reduce the discomfort to be caused to the seated person.

Means for Solving the Problems

In order to solve the above problems, the present disclosure adopts the following aspects.

A chair of an aspect of the present disclosure includes: a support structure; and a chair body including a first member that extends in a forward-rearward direction and forms at least part of a seat, and a second member that is provided in a rear end of the first member to be pivotable around a first axis extending in a left-right direction, extends upward from the first member, and forms at least part of a backrest, wherein the support structure includes a first supporting portion that supports, in front of the first axis, the first member movably in the forward-rearward direction, and a second supporting portion that supports, below the first axis, the second member pivotably around a second axis extending in the left-right direction.

According to this aspect, as the second member pivots around the second axis relative to the support structure, the second member pivots around the first axis relative to the first member, and the first member slides in the forward-rearward direction relative to the support structure. Thereby, compared to a configuration in the related art in which the front end portion of the seat is moved up as the backrest pivots rearward, the movement of the first member in the up-down direction as the second member pivots rearward can be limited. That is, the first member can be smoothly moved in the forward-rearward direction as the second member pivots, so the discomfort that the seated person feels when reclining can be reduced.

In the chair of the above aspect, the chair body may include a coupling member that couples the first member and the second member pivotably around the first axis.

According to this aspect, by using the coupling member that is a different body from the first member and the second member, while the strength of the chair body can be secured, the pivoting amount or the like of the second member relative to the first member can be easily adjusted.

In the chair of the above aspect, the chair body may be configured to be pivotable between a first position and a second position, the first position in which an angle around the first axis between the first member and the second member is a first angle, and the second position in which the angle around the first axis between the first member and the second member is a second angle less than the first angle, the second supporting portion may be a shaft member extending along the second axis, the second member may include a holder including an opening that opens in an intersecting direction intersecting with the second axis and into which the second supporting portion is insertable, and holding the second supporting portion, and a retainer, in which the retainer engages with the support structure in the intersecting direction when the chair body is in the first position to limit the second member from moving in the intersecting direction relative to the support structure, and the retainer is separated from the support structure when the chair body is in the second position to allow the second member to move in the intersecting direction relative to the support structure.

According to this aspect, in a state where the chair body is in the second position, when the holder and the second supporting portion are made to approach or be separated from each other in the intersecting direction, the second supporting portion can be attached to and detached from the holder through the opening. On the other hand, in a state where the second supporting portion is accommodated in the holder, when the chair body is made to be in the first position, the second supporting portion can be limited from being separated from the holder through the opening Thereby, even when a configuration is used in which the first member and the second member are combined together, the assemblability thereof can be improved.

In the chair of the above aspect, either one member of the second member and the support structure may be detachably provided with a restraining portion that engages with the other member of the second member and the support structure when the chair body is in the first position to restrain the chair body from pivoting around the first axis toward the second position.

According to this aspect, after the second member is attached to the support structure, the second member can be limited from returning to the second position. Thereby, both assemblability and reliability after assembly can be secured.

In the chair of the above aspect, the first member may be provided with a slit including another opening that opens in the forward-rearward direction and into which the first supporting portion is insertable, and extending in the forward-rearward direction, and the first supporting portion may be configured to be movable in the forward-rearward direction inside the slit.

According to this aspect, the second supporting portion can be inserted into the slit through the other opening. Thereby, it is possible to improve the assemblability of the first member to the support structure.

Effects of the Invention

According to each aspect described above, it is possible to reduce the discomfort to be caused to the seated person.

EMBODIMENTS FOR CARRYING OUT THE INVENTION

Next, an embodiment of the present disclosure is described based on the drawings. In the embodiments and modifications described below, the same reference sign may be attached to corresponding components, and the description thereof may be omitted. In the following description, expressions indicating relative or absolute arrangements such as "parallel", "orthogonal", "center", and "coaxial" do not only strictly represent such arrangements but also represent states having relative shifts with tolerances and angles and distances to an extent that the same function can be obtained. In this embodiment, the term "facing each other" does not include only a case where the orthogonal directions (normal directions) to two surfaces are parallel with each other but also include a case where the orthogonal directions intersect with each other.

Figure 1:
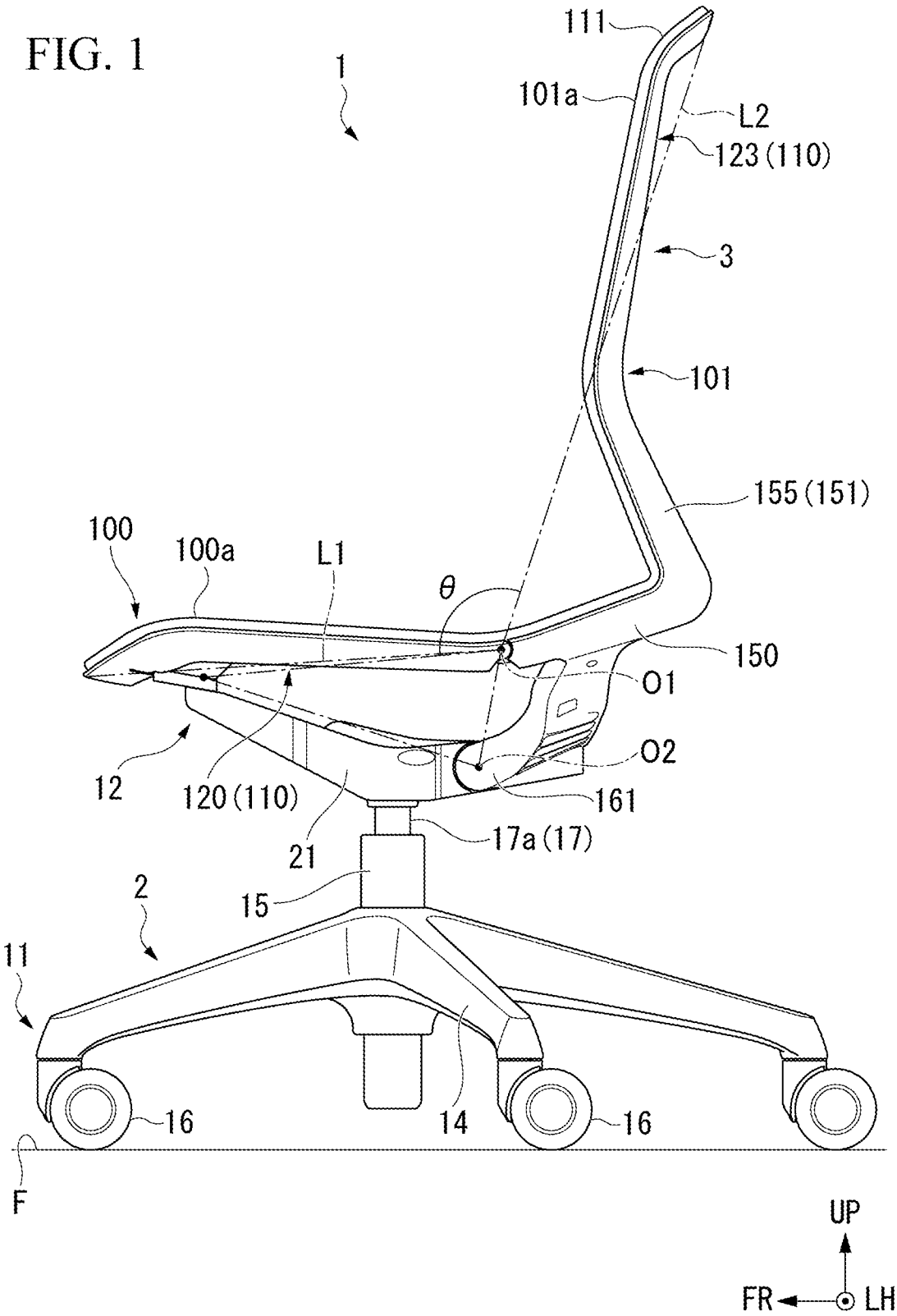
FIG. 1 is a side view of a chair of an embodiment.

FIG. 1 is a side view of a chair 1.

As shown in FIG. 1, the chair 1 includes a support structure 2 and a chair body 3. In the following description, directions such as forward-rearward, up-down, and left-right directions are the same as those of a person (seated person) seating oneself in the chair 1 in the normal orientation. In this case, in the drawings, an arrow UP indicates upward, an arrow FR indicates forward, and an arrow LII indicates leftward. In the following description, in the chair 1, a side away from the center in the forward-rearward direction or the left-right direction (width direction) may be referred to as the outside, and a side toward the center may be referred to as the inside.

<Support Structure 2>

The support structure 2 includes a leg 11 and a support base 12.

The leg 11 includes a branching leg 14 and a pedestal 15.

A caster 16 that can travel on a floor F is attached to each leg of the branching leg 14.

The pedestal 15 is erected upward from the center of the branching leg 14. The pedestal 15 has a gas spring 17 built-in, which is a lift mechanism for the chair 1. The gas spring 17 has, for example, a configuration in which an inner cylinder 17*a* is supported by an outer cylinder (not shown) provided inside the pedestal 15 such that the inner cylinder 17*a* can move up and down and can rotate relative to the outer cylinder.

Figure 2:
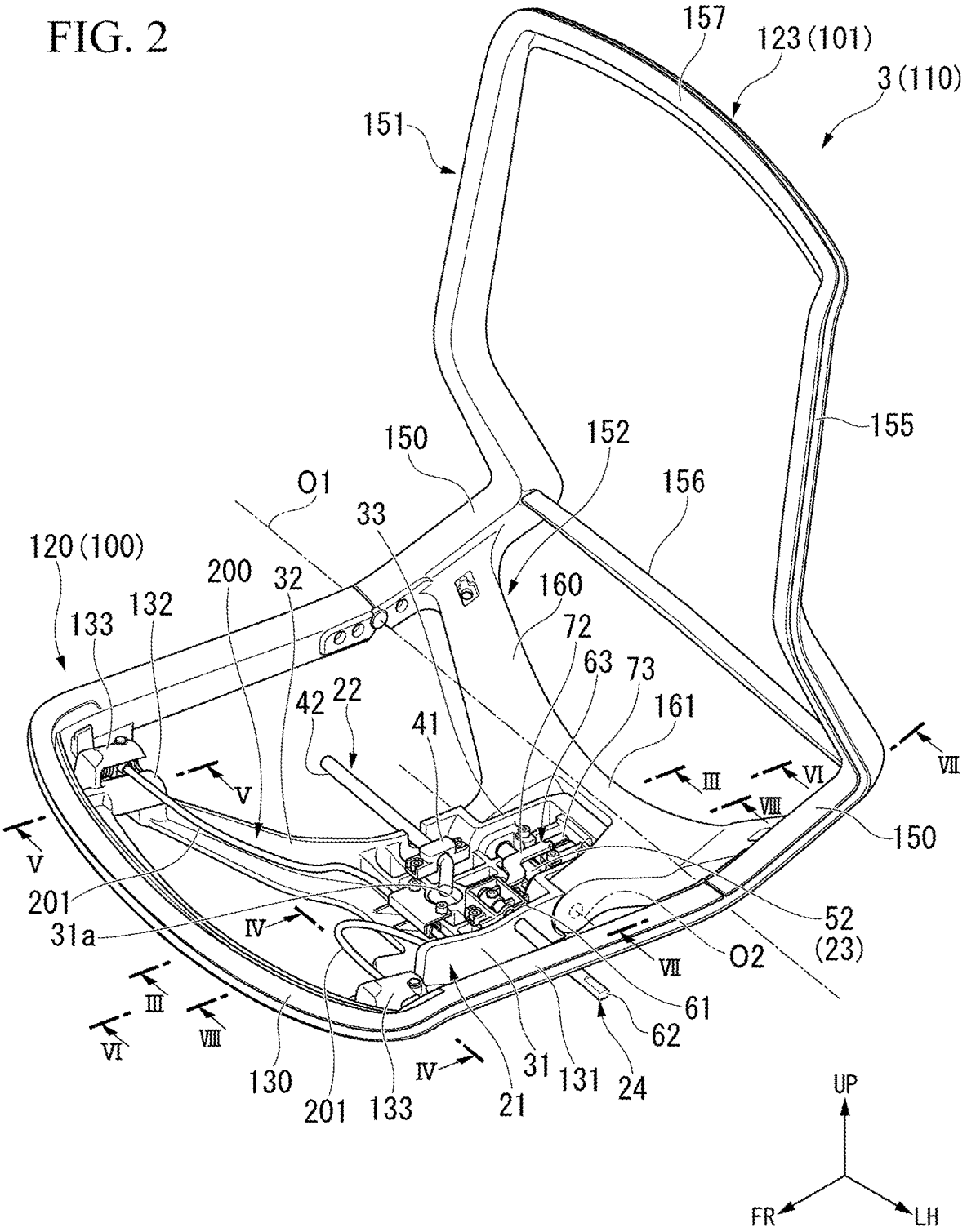
FIG. 2 is a perspective view of a chair body and a support base of the embodiment.

FIG. 2 is a perspective view of the chair body 3 and the support base 12. In FIG. 2, a tensile material 111 of the chair body 3 is omitted.

As shown in FIGS. 1 and 2, the support base 12 is fixed to the upper end portion of the pedestal 15 (the inner cylinder 17*a*). As shown in FIG. 2, the support base 12 includes a casing 21, a lifting operation mechanism 22, a tilting mechanism 23, and a tilting adjustment mechanism 24.

The casing 21 is formed in a box shape that opens upward. The casing 21 is integrally formed of aluminum or the like. Specifically, the casing 21 includes a case body 31, two forward extending portions 32, and a rear case 33.

Figure 3:
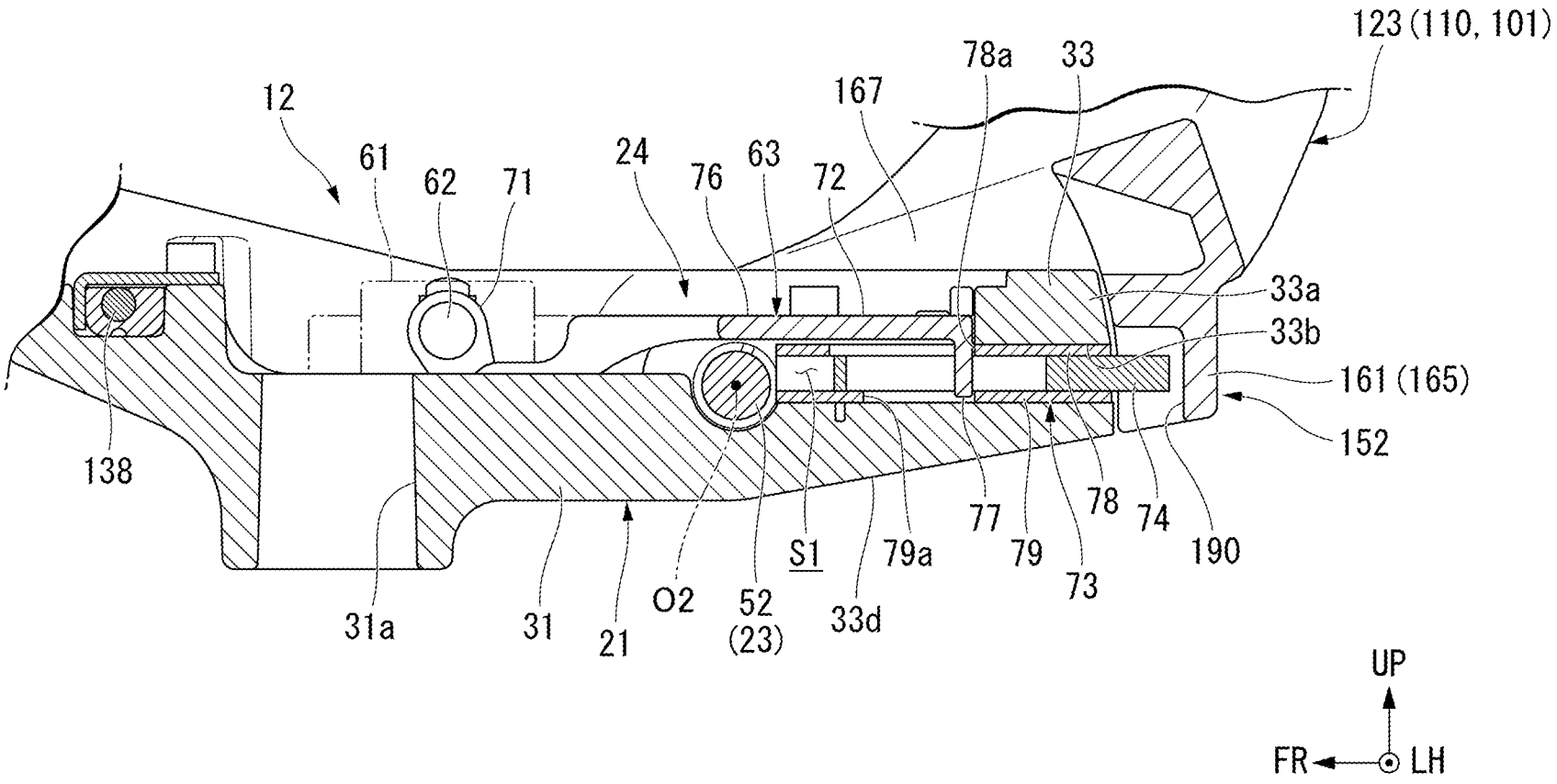
FIG. 3 is a cross-sectional view taken along line III-III in FIG. 2.

FIG. 3 is a cross-sectional view taken along line III-III in FIG. 2.

As shown in FIG. 3, the bottom wall of the case body 31 is provided with an insertion opening 31*a* penetrating through the bottom wall. The inner cylinder 17*a* is attached to the casing 21 through the insertion opening 31*a*.

As shown in FIG. 2, the two forward extending portions 32 extend forward from two ends of the case body 31 in the left-right direction. The two forward extending portions 32 extend to be inclined upward and forward in a side view. The two forward extending portions 32 extend forward and outward in the left-right direction in a plan view.

The rear case 33 extends rearward from the center of the case body 31 in the left-right direction. The width of the rear case 33 in the left-right direction is less than that of the case body 31. In the casing 21, ribs, punched portions, and the like are appropriately provided.

The lifting operation mechanism 22 includes a bearing 41 and an operation rod 42.

The bearing 41 is provided in right of the insertion opening 31*a* inside the case body 31.

The operation rod 42 is supported by the bearing 41 to be rotatable around an axis in the left-right direction. An inner end portion of the operation rod 42 in the left-right direction is linked to the inner cylinder 17*a* inside the case body 31. An outer end portion of the operation rod 42 in the left-right direction penetrates through a side wall of the case body 31 and protrudes rightward from the case body 31. A handle (not shown) is attached to the outer end portion of the operation rod 42 in the left-right direction on the outside of the casing 21. The lifting operation mechanism 22 operates the gas spring 17 by performing rotational operation on the operation rod 42 through the handle.

The tilting mechanism 23 includes a slider (a first supporting portion: refer to FIG. 4) 51 and a backrest-supporting shaft (a second supporting portion) 52.

Figure 4:
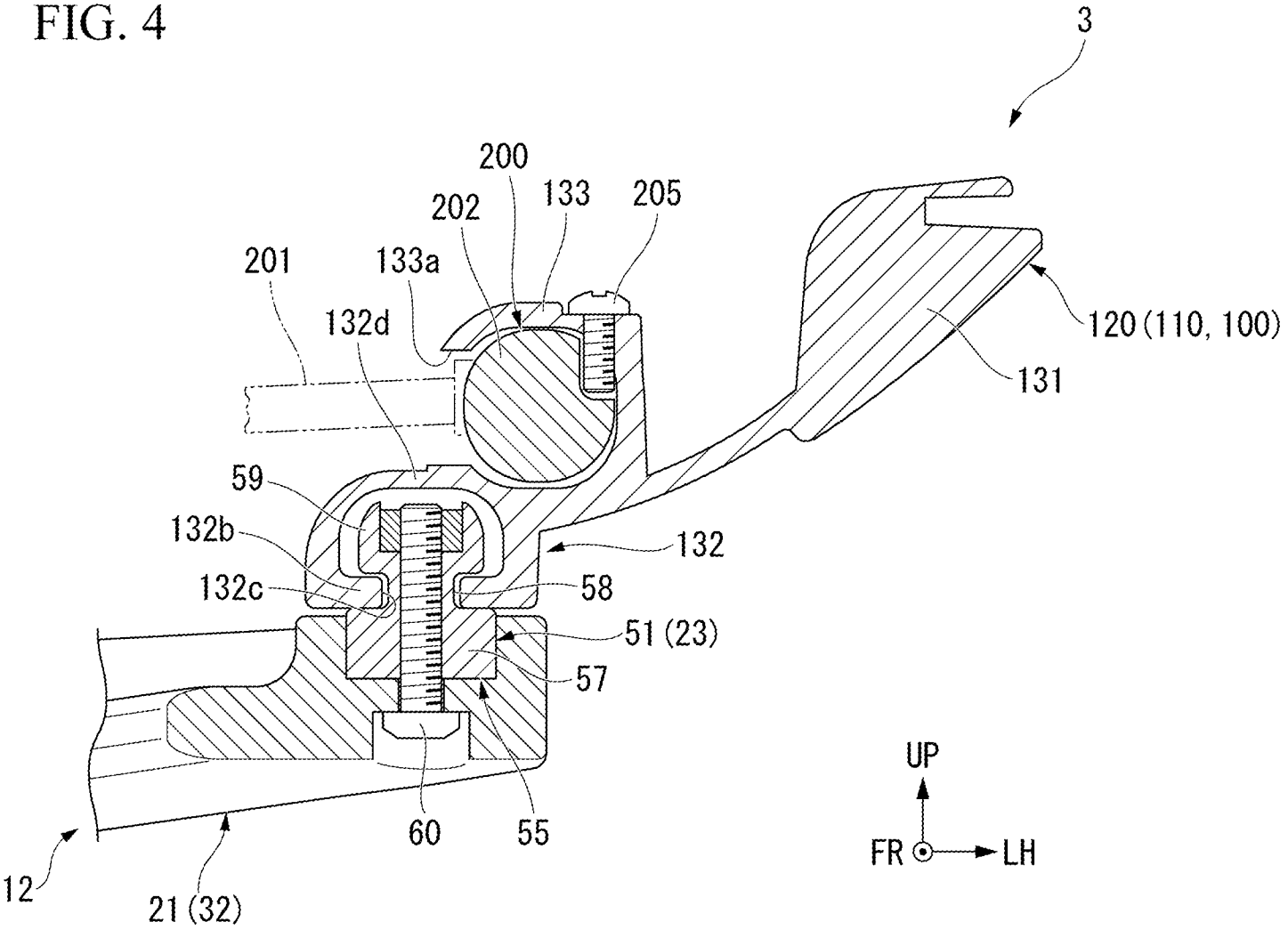
FIG. 4 is a cross-sectional view taken along line IV-IV in FIG. 2.
Figure 5:
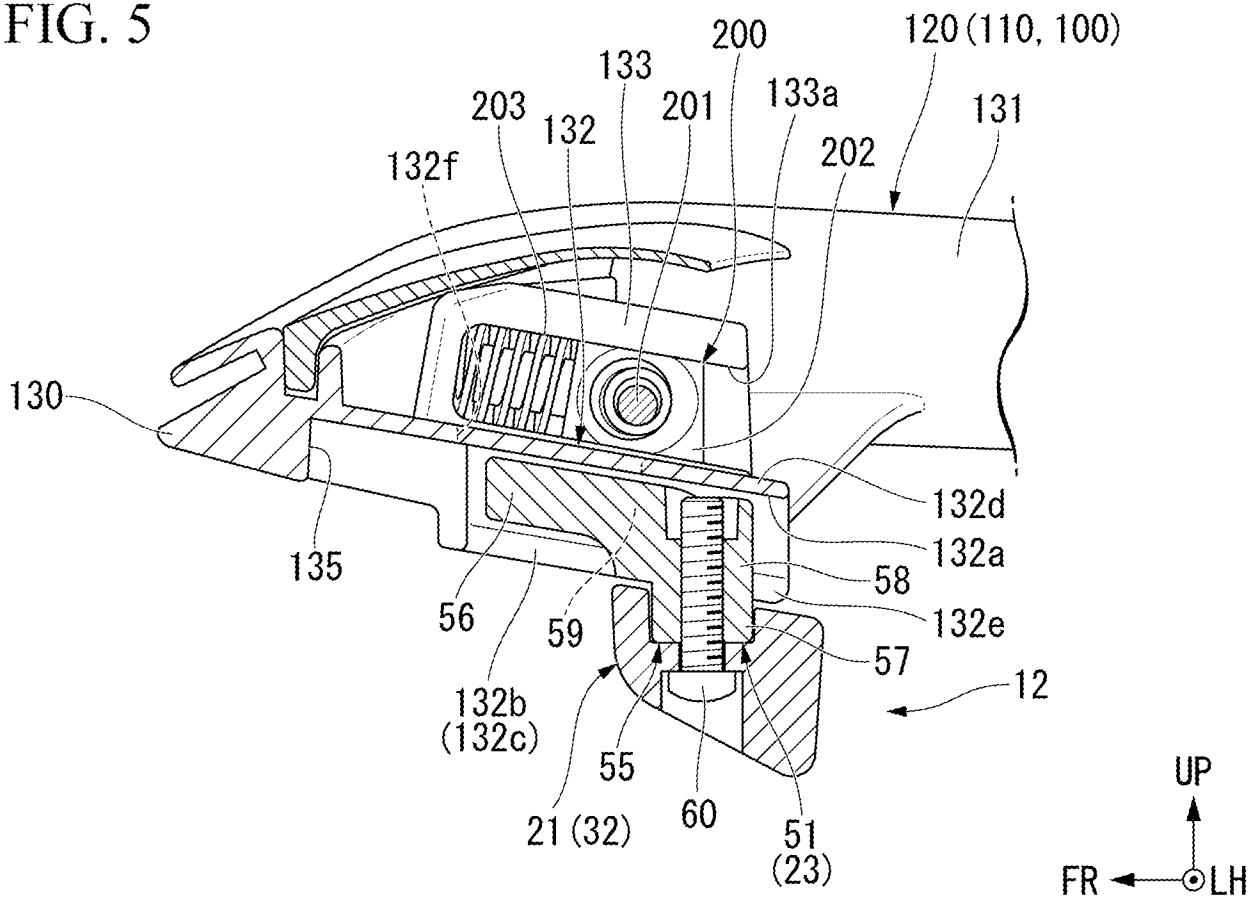
FIG. 5 is a cross-sectional view taken along line V-V in FIG. 2.

FIG. 4 is a cross-sectional view taken along line IV-IV in FIG. 2. FIG. 5 is a cross-sectional view taken along line V-V in FIG. 2.

As shown in FIGS. 4 and 5, the slider 51 is provided in the front end portion of each forward extending portion 32. The slider 51 includes a connecting portion 55 and an entry-preventing piece 56. The connecting portion 55 is formed in an I-shaped block shape in a front view. The connecting portion 55 includes a lower wall 57, a post 58, and an upper wall 59.

The lower wall 57 is fixed on the front end portion of the forward extending portion 32 by a screw 60 or the like.

The post 58 extends upward from the center of the lower wall 57 in the left-right direction.

The upper wall 59 protrudes toward two sides of the post 58 in the left-right direction.

As shown in FIG. 5, the entry-preventing piece 56 extends forward from the connecting portion 55 in a cantilever manner.

As shown in FIG. 2, the backrest-supporting shaft 52 is a shaft member that penetrates through the rear case 33 in the left-right direction. Two ends of the backrest-supporting shaft 52 in the left-right direction protrude from side walls of the rear case 33 to the outside of the rear case 33.

The tilting adjustment mechanism 24 includes a bearing 61, an operation rod 62, and a link mechanism 63.

The bearing 61 is provided in left of the insertion opening 31*a* inside the case body 31.

The operation rod 62 is supported by the bearing 61 to be rotatable around an axis in the left-right direction. An outer end portion of the operation rod 62 in the left-right direction penetrates through a side wall of the case body 31 and protrudes leftward from the case body 31. A handle (not shown) is attached to the outer end portion of the operation rod 62 in the left-right direction on the outside of the casing 21.

Figure 6:
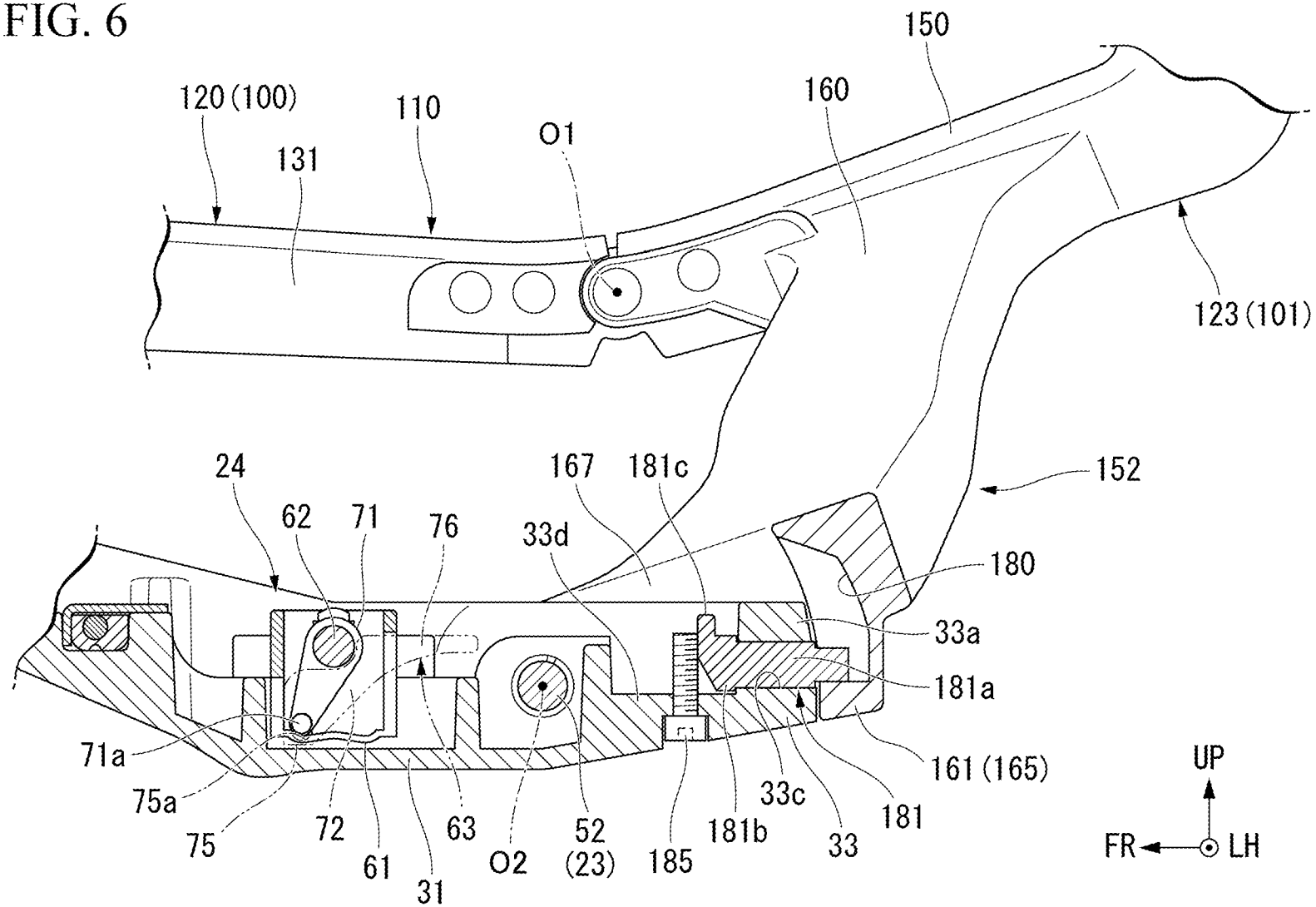
FIG. 6 is a cross-sectional view taken along line VI-VI in FIG. 2.

FIG. 6 is a cross-sectional view taken along line VI-VI in FIG. 2.

As shown in FIGS. 3 and 6, the link mechanism 63 includes a first arm 71, a second arm 72, a guide portion 73, and an advance/retraction piece 74.

As shown in FIG. 6, the first arm 71 is fixed to the inner end portion of the operation rod 62 in the left-right direction. The first arm 71 extends in a radial direction (downward) of the operation rod 62 from the operation rod 62. The tip portion of the first arm 71 is provided with a link pin 71*a* protruding inward in the left-right direction. The link pin 71*a* moves in the forward-rearward direction around the operation rod 62 as the operation rod 62 rotates.

The second arm 72 is configured to be movable in the forward-rearward direction as the link pin 71*a* moves in the forward-rearward direction as the operation rod 62 rotates. The second arm 72 includes a first coupling piece 75, a connecting piece 76, and a second coupling piece 77 (refer to FIG. 3).

The first coupling piece 75 is formed in a plate shape whose thickness direction is the left-right direction. The lower end portion of the first coupling piece 75 is provided with an insertion hole 75*a*. The insertion hole 75*a* is formed in an elongated hole. The link pin 71*a* is inserted into the insertion hole 75*a*.

The connecting piece 76 extends rearward from the upper end portion of the coupling piece 75. As shown in FIG. 2, the connecting piece 76 extends rearward in a state of being bent in a crank shape in the left-right direction in a plan view. The rear end portion of the connecting piece 76 is positioned behind the backrest-supporting shaft 52 inside the rear case 33.

As shown in FIG. 3, the second coupling piece 77 protrudes downward from the rear end portion of the connecting piece 76.

The guide portion 73 is fixed inside the rear case 33 in a state of being inserted into a through-hole 33*b* provided in a rear wall 33*a* of the rear case 33. The guide portion 73 includes an upper plate 78 and a lower plate 79 that face each other in the up-down direction. A space surrounded by the upper plate 78 and the lower plate 79 configures a slide space Si. The upper plate 78 is provided with an upper slit 78*a* extending in the forward-rearward direction. A position of the lower plate 79 facing the upper slit 78*a* is provided with a lower slit 79*a* extending in the forward-rearward direction. The second coupling piece 77 bridges an area between the upper slit 78*a* and the lower slit 79*a*. The second coupling piece 77 is inserted into the upper slit 78*a* from above the upper plate 78 and traverses the slide space Si in the up-down direction.

The advance/retraction piece 74 is accommodated in the slide space Si so as to be movable thereinside in the forward-rearward direction. The advance/retraction piece 74 is formed in a plate shape whose thickness direction is the up-down direction and extending in the forward-rearward direction. The advance/retraction piece 74 is connected to the second coupling piece 77 within the slide space Si. The advance/retraction piece 74 moves in the forward-rearward direction as the second arm 72 moves in the forward-rearward direction. The advance/retraction piece 74 moves in the forward-rearward direction between a projecting position (refer to FIG. 3) in which it projects rearward from the casing 21 through the through-hole 33*b* and a retracting position (refer to FIG. 10) in which it retracts into the casing 21. The advance/retraction piece 74 may be connected to the second coupling piece 77 in a state of being pushed toward the projecting position by a pushing member such as a spring or may be directly connected to the second coupling piece 77.

<Chair Body 3>

As shown in FIG. 1, the chair body 3 includes a seat 100 and a backrest 101.

The seat 100 extends in the forward-rearward direction in a side view. In the example shown in the drawings, the seat 100 is inclined downward from the rear toward the front. The upper surface of the seat 100 configures a seat surface 100*a* that supports an area of the seated person from the buttocks to the thighs thereof from below. The seat 100 is supported by the support base 12 to be slidable with respect thereto in the forward-rearward direction.

The backrest 101 extends upward from the rear end of the seat 100. The backrest 101 of this embodiment has a gentle S-shape in a side view. The front surface of the backrest 101 configures a back-supporting surface 101*a* that supports the waist and back of the seated person from behind. The chair body 3 may include armrests.

The backrest 101 is provided in the seat 100 so as to be pivotable around an axis O1 extending in the left-right direction. The backrest 101 is connected to the support base 12 so as to be pivotable around an axis O2 of the backrest-supporting shaft 52. The seat 100 is provided so as to be slidably movable relative to the support base 12 in the forward-rearward direction as the backrest 101 pivots around the axis O2 relative to the support base 12 and the backrest 101 pivots around the axis O1 relative to the seat 100.

Hereinafter, the specific configuration of the chair body 3 is described.

The chair body 3 includes a shell 110 and the tensile material 111.

The shell 110 is a frame-shaped member that forms the outer shell of the chair body 3. The shell 110 includes a seat frame 120 forming the outer shell of the seat 100, a back frame 123 forming the outer shell of the backrest 101, and a coupling member 121 coupling the seat frame 120 and the back frame 123 together. The seat frame 120, the coupling member 121 and the back frame 123 are each molded of a resin material or the like.

As shown in FIG. 2, the seat frame 120 is formed in a U-shape that opens rearward in a plan view. Specifically, the seat frame 120 includes a front rod 130, side rods 131, seat-engaging portions 132 (refer to FIG. 4), and spring-accommodating portions 133 (refer to FIG. 4).

The front rod 130 extends in the left-right direction at the front end portion of the seat 100.

The side rods 131 extend rearward from two ends of the front rod 130 in the left-right direction.

Figure 7:
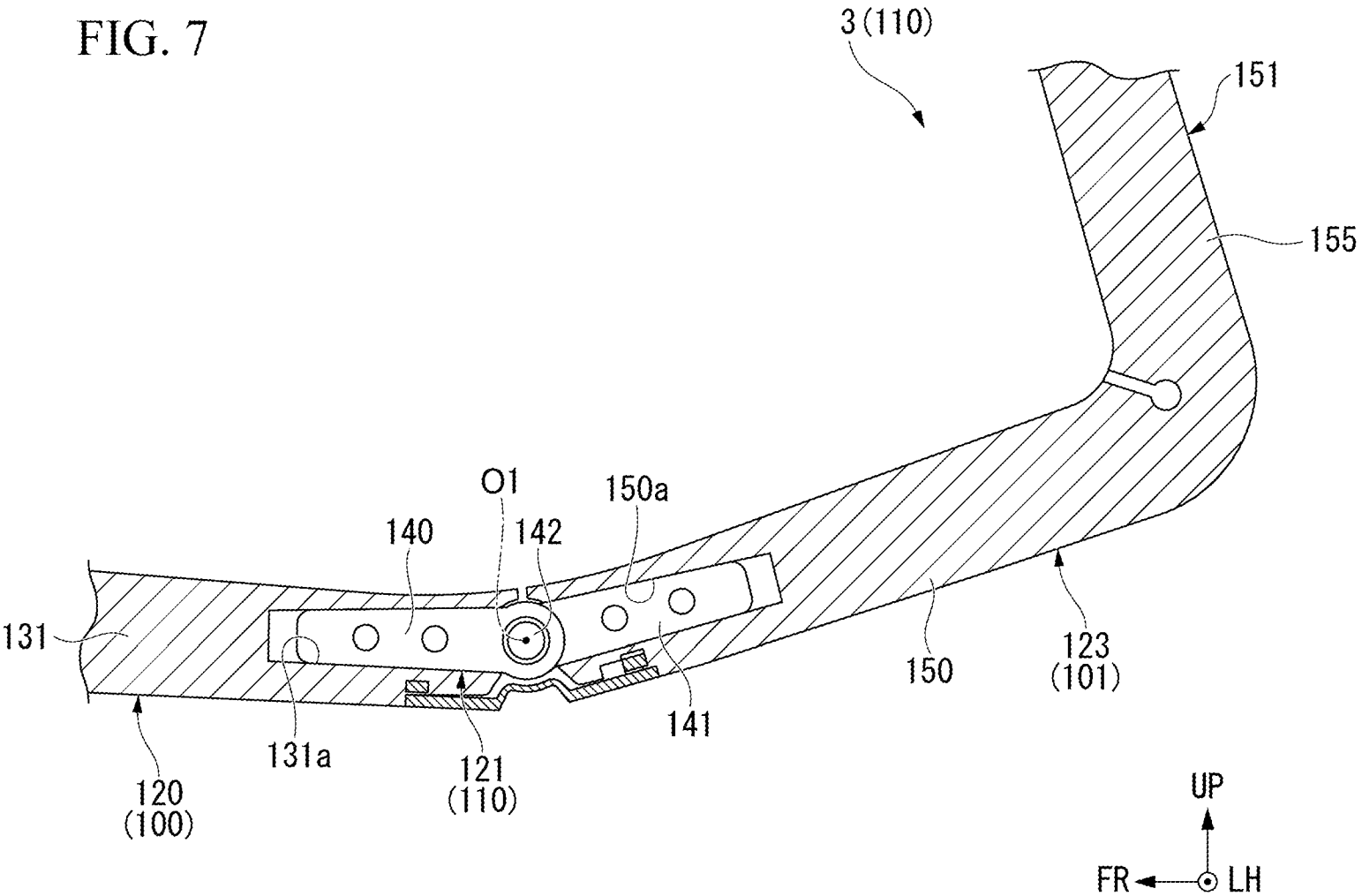
FIG. 7 is a cross-sectional view taken along line VII-VII in FIG. 2.

FIG. 7 is a cross-sectional view taken along line VII-VII in FIG. 2.

As shown in FIG. 7, the rear end surface of each side rod 131 is provided with a recess 131*a* that opens on the rear end surface. The rear end surface of the side rod 131 is formed as an inclined surface extending downward and forward.

As shown in FIGS. 4 and 5, the seat-engaging portion 132 is supported by the slider 51 so as to be movable in the forward-rearward direction relative to the support base 12. The seat-engaging portions 132 are formed integrally with the front rod 130 or the side rods 131 at two end portions of the front rod 130 in the left-right direction. In the following description, the configuration of the seat-engaging portion 132 is described using one seat-engaging portion 132 as an example.

The seat-engaging portion 132 is formed in a tubular shape extending in the forward-rearward direction. In this embodiment, the seat-engaging portion 132 extends to be inclined or curved slightly downward as going rearward. The seat-engaging portion 132 is provided with a rear end opening 132*a* (refer to FIG. 5) that opens rearward. A bottom wall 132*b* of the seat-engaging portion 132 is provided with a slit 132*c*. The slit 132*c* extends in the forward-rearward direction. The slit 132*c* includes a slit opening (another opening) 132*e* that opens on the rear end surface of the bottom wall 132*b*. A position of the front rod 130 facing the seat-engaging portion 132 in the forward-rearward direction is provided with an escape portion 135. The escape portion 135 extends in the forward-rearward direction on an extension line of the slit 132*c*. The escape portion 135 opens rearward and downward.

Inside the seat-engaging portion 132, the slider 51 is accommodated through the rear end opening 132*a* and the slit opening 132*e*. Specifically, in the slider 51, the upper wall 59 is disposed inside the seat-engaging portion 132 in a state where the post 58 penetrates through the slit 132*c* in the up-down direction. Therefore, the post 58 is configured to be movable in the forward-rearward direction in the slit 132*c* in a state where the post 58 is limited from moving in the left-right direction by inner surfaces of the slit 132*c*. The upper wall 59 is configured to be movable in the forward-rearward direction in the seat-engaging portion 132 in a state where the upper wall 59 is limited from moving in the up-down direction by the bottom wall 132*b* and a top wall 132*d* of the seat-engaging portion 132.

The entry-preventing piece 56 overlaps the slit 132*c* inside the seat-engaging portion 132 in a plan view. The entry-preventing piece 56 enters or moves away from the escape portion 135 as the slider 51 moves in the forward-rearward direction. The entry-preventing piece 56 prevents fingers, articles or the like from entering the seat-engaging portion 132 through the slit 132*c*.

The spring-accommodating portion 133 is provided integrally with the seat-engaging portion 132 above the seat-engaging portion 132. The spring-accommodating portion 133 is formed in a tubular shape that opens rearward. The spring-accommodating portion 133 is provided with a slide-permitting portion 133*a* that opens inward in the left-right direction. The slide-permitting portion 133*a* is a slit extending in the forward-rearward direction and opening on the rear end edge of the spring-accommodating portion 133.

As shown in FIG. 7, the coupling member 121 includes a seat-connecting portion 140, a back-connecting portion 141, and a pivot 142.

The seat-connecting portion 140 is a rod-shaped member extending in the forward-rearward direction. The seat-connecting portion 140 is inserted into the recess 131*a* of the side rod 131 from behind. The seat-connecting portion 140 is fixed to the side rod 131 by fastening screws or the like to the side rod 131 from the inside in the left-right direction.

The back-connecting portion 141 is formed in a rod shape extending rearward from the rear end portion of the seat-connecting portion 140. The front end portion of the back-connecting portion 141 overlaps the rear end portion of the seat-connecting portion 140 in the left-right direction.

The pivot 142 is formed in a rod shape extending in the left-right direction. The pivot 142 penetrates in the left-right direction through the overlapping portion of the rear end portion of the seat-connecting portion 140 and the front end portion of the back-connecting portion 141. Therefore, the seat-connecting portion 140 and the back-connecting portion 141 are configured to be pivotable around the axis O1 of the pivot 142.

The back frame 123 includes lower frames 150, a body frame 151, and a support frame 152 (refer to FIG. 2).

The lower frame 150 is coupled to the rear end of the side rod 131 through the coupling member 121. The lower frame 150 is inclined upward as it goes rearward. The front end surface of the lower frame 150 is provided with a recess 150*a* that opens forward. The back-connecting portion 141 is inserted into the recess 150*a*. The back-connecting portion 141 is fixed to the lower frame 150 by fastening screws or the like to the lower frame 150 from the inside in the left-right direction.

Thus, in the shell 110 of this embodiment, the seat frame 120 and the back frame 123 are combined together through the coupling members 121. Thereby, the back frame 123 is configured to be pivotable around the axis O1 relative to the seat frame 120.

As shown in FIG. 2, the body frame 151 is formed in a rectangular frame shape in a front view. Specifically, the body frame 151 includes two vertical rods 155, a lower rod 156, and an upper rod 157.

The two vertical rods 155 extend upward from the rear ends of the lower frames 150. In a side view, the vertical rod 155 extends forward as it goes upward and then further extends rearward as it goes upward.

The lower rod 156 bridges the lower end portions of the two vertical rods 155 in the left-right direction.

The upper rod 157 bridges the upper end portions of the two vertical rods 155 in the left-right direction.

The support frame 152 bridges a space between the lower frames 150. The support frame 152 includes two connecting frames 160 and a support base-connecting portion 161.

The connecting frames 160 extend inward in the left-right direction from the lower frames 150. The connecting frame 160 extends to be curved downward as it goes inward in the left-right direction.

As shown in FIG. 1, the support base-connecting portion 161 connects between the two connecting frames 160. The support base-connecting portion 161 is positioned below the lower frame 150 in a side view. The support base-connecting portion 161 is positioned on an inner side with respect to the two lower frames 150 in the left-right direction as shown in FIG. 2. The support base-connecting portion 161 is formed in a U-shape that opens forward. As shown in FIG. 3, the support base-connecting portion 161 includes a restraining wall 165 and two front protrusions 167.

The restraining wall 165 extends in the left-right direction.

The front protrusions 167 extend diagonally forward and downward from two end portions of the restraining wall 165 in the left-right direction.

Figure 8:
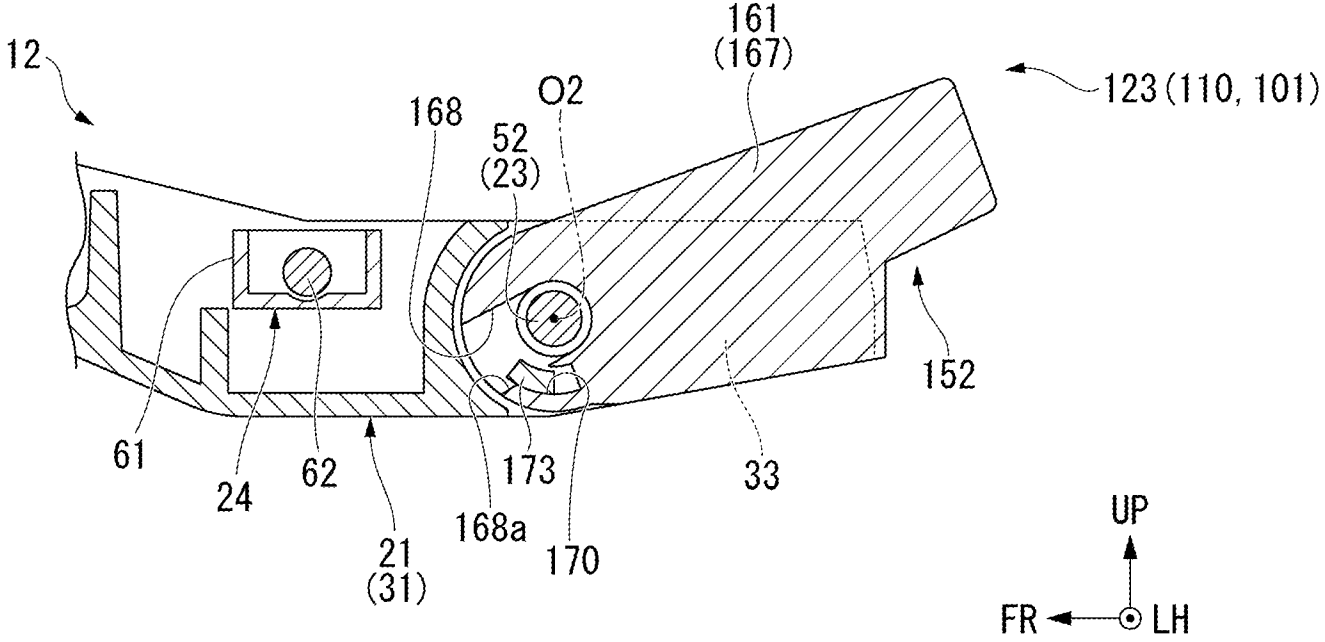
FIG. 8 is a cross-sectional view taken along line VIII-VIII in FIG. 2.

FIG. 8 is a cross-sectional view taken along line VIII-VIII in FIG. 2.

As shown in FIG. 8, a holder 168 is formed on an inner surface of the front end portion of the front protrusion 167. The holder 168 is a recess that opens inward in the left-right direction at the front protrusion 167. The holder 168 holds the portion of the backrest-supporting shaft 52 protruding from the rear case 33. Thereby, the back frame 123 is supported by the backrest-supporting shaft 52 as a fulcrum to be pivotable around the axis O2 extending in the left-right direction. The holder 168 includes an insertion opening (opening) 168*a* that opens on the front end surface of the front protrusion 167. The backrest-supporting shaft 52 is insertable into the holder 168 through the insertion opening 168*a*. The insertion opening 168*a* opens in a radial direction (intersecting direction) of the axis O2 in a state where the backrest-supporting shaft 52 is accommodated in the holder 168.

A portion of the inner surface of the holder 168, which faces in the circumferential direction around the axis O2, is provided with a retainer 170. The retainer 170 is an arc-shaped groove extending in the circumferential direction around the axis O2. The retainer 170 opens on the inner surface of the holder 168 and opens inward in the left-right direction at the front protrusion 167.

Portions of two side walls of the rear case 33, which face the front protrusions 167 in the left-right direction, are provided with protrusions 173. The protrusion 173 is accommodated in the retainer 170. The protrusion 173 advances to or retreats from the retainer 170 according to an angle θ (refer to FIG. 1) of the back frame 123 with respect to the seat frame 120.

As shown in FIG. 1, the angle θ of the back frame 123 with respect to the seat frame 120 is an angle between a first virtual line L1 connecting the axis O1 and the front end of the seat frame 120 and a second virtual line L2 connecting the axis O1 and the upper end of the back frame 123 in a side view. In this embodiment, when the angle θ of the chair body 3 is a first angle, as shown in FIG. 8, the protrusion 173 is accommodated in the retainer 170 (use position (first position)). In the use position, the protrusion 173 engages with (contacts) the inner surface of the retainer 170 in a radial direction (forward-rearward direction) of the axis O2, thereby limiting the back frame 123 from moving rearward relative to the backrest-supporting shaft 52.

Figure 9:
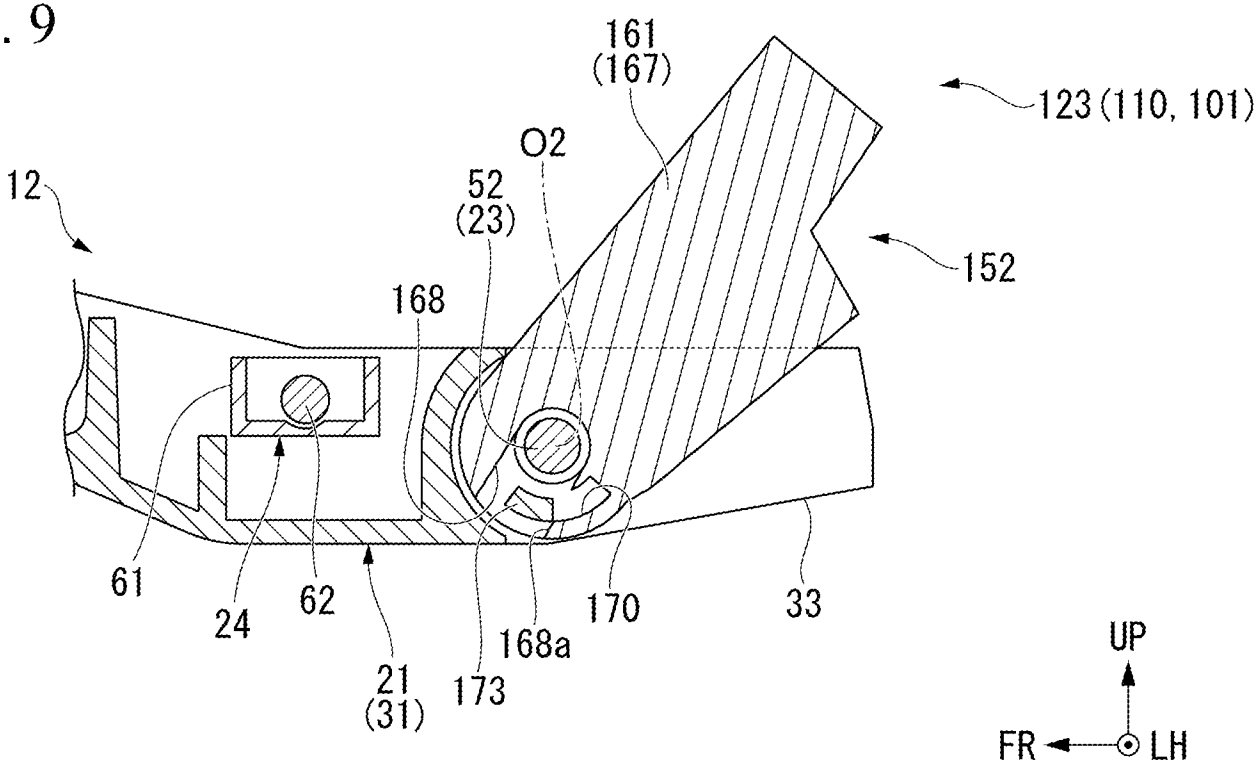
FIG. 9 is a cross-sectional view corresponding to FIG. 8 and showing a state where the chair body of the embodiment is in an assembly position.

FIG. 9 is a cross-sectional view corresponding to FIG. 8 and showing a state where the chair body 3 is in an assembly position (second position).

As shown in FIG. 9, when the angle θ of the chair body 3 is a second angle less than the first angle, the protrusion 173 is away from the retainer 170 (the assembly position). In the assembly position, the entire protrusion 173 is positioned inside the holder 168 so that the engagement (contact) with the retainer 170 is released. That is, in the assembly position, the back frame 123 is allowed to move in a radial direction (rearward) of the axis O2 relative to the backrest-supporting shaft 52. As a result, the backrest-supporting shaft 52 and the protrusion 173 are detachable from the holder 168. It is sufficient that the entry amount of the protrusion 173 into the holder 168 at the assembly position is greater than the entry amount of the protrusion 173 into the holder 168 at the use position.

As shown in FIG. 6, the front surface of the restraining wall 165 is provided with vertical grooves 180. The vertical grooves 180 extend in the up-down direction at two end portions of the restraining wall 165 in the left-right direction. Return stoppers (restraining portions) 181 are locked in the vertical grooves 180. In the following description, one return stopper 181 of the return stoppers 181 locked in one vertical groove 180 is described.

The return stopper 181 is detachably attached to the rear wall 33*a*. The return stopper 181 includes a shaft 181*a*, a flange 181*b*, and a tab 181*c*.

The shaft 181*a* is formed in a rod shape extending in the forward-rearward direction. A position in the rear wall 33*a* of the rear case 33 described above, which faces the vertical groove 180 in the forward-rearward direction, is provided with an insertion hole 33*c* penetrating through the rear wall 33*a*. The shaft 181*a* penetrates the rear wall 33*a* through the insertion hole 33*c*. The tip portion (rear end portion) of the shaft 181*a* protrudes rearward from the rear case 33. The tip portion of the shaft 181*a* enters the vertical groove 180. The return stopper 181 limits the back frame 123 from pivoting toward the assembly position by the shaft 181*a* engaging with (contacting) the lower surface (surface facing upward of the inner surface) of the vertical groove 180 from above.

The flange 181*b* is provided in the base end portion (front end portion) of the shaft 181*a* by increasing the diameter of the shaft 181*a*. The flange 181*b* is close to or in contact with the rear wall 33*a* from the front. The flange 181*b* is provided with a tapered surface extending diagonally forward and upward.

The tab 181*c* protrudes upward from the flange 181*b*.

A portion of the rear case 33 positioned in front of the return stopper 181 is provided with a positioning bolt 185. The positioning bolt 185 is provided so as to protrude into the rear case 33 from a bottom wall 33*d* of the rear case 33. The positioning bolt 185 is disposed in front of the flange 181*b* and limits the return stopper 181 from moving forward relative to the rear case 33. That is, the positioning bolt 185 limits the return stopper 181 from coming off the vertical groove 180.

Figure 10:
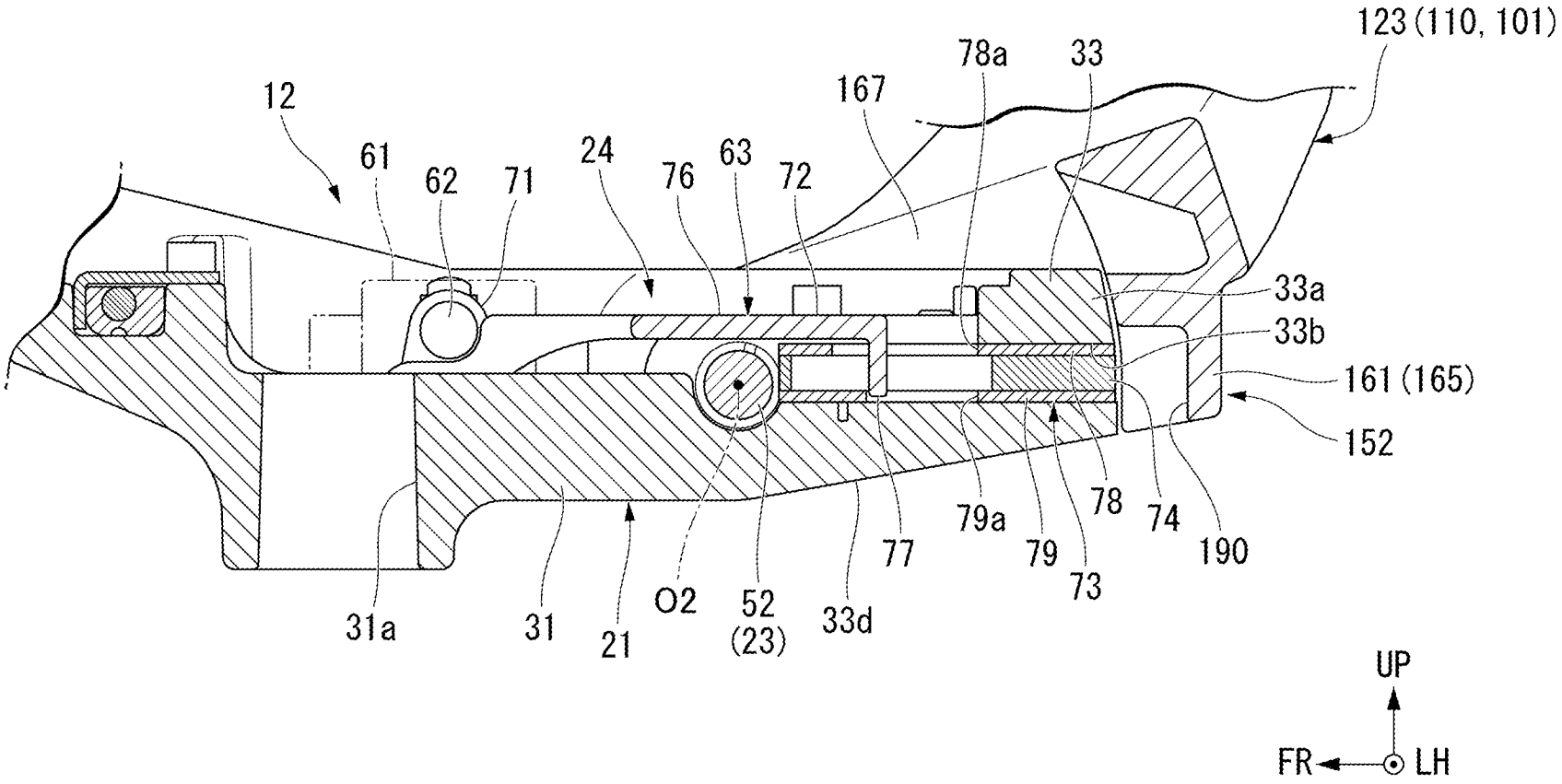
FIG. 10 is a cross-sectional view corresponding to FIG. 3 and showing a state where an advance/retraction piece is in a retracting position.

As shown in FIG. 3, a portion of the restraining wall 165 positioned between the vertical grooves 180 is provided with a tilt-regulating portion 190. The tilt-regulating portion 190 is a recess that opens on the front and bottom surfaces of the restraining wall 165. The rear end portion of the advance/retraction piece 74 enters the tilt-regulating portion 190 when the advance/retraction piece 74 is in the projecting position. When the advance/retraction piece 74 is in the projecting position, the upper surface of the tilt-regulating portion 190 contacts the advance/retraction piece 74 as the back frame 123 pivots rearward. Thereby, the pivoting range of the back frame 123 relative to the seat frame 120 is regulated. On the other hand, as shown in FIG. 10, when the advance/retraction piece 74 is in the retracting position, the advance/retraction piece 74 retracts from the tilt-regulating portion 190. That is, when the advance/retraction piece 74 is in the retracting position, the advance/retraction piece 74 retracts from the pivoting locus of the back frame 123 to allow the back frame 123 to pivot. When the advance/retraction piece 74 is in the retracting position, the back frame 123 comes into contact with a restraining portion (not shown) provided in the casing 21 so that the pivoting range thereof is regulated. It is sufficient that the pivoting range of the back frame 123 when the tilt-regulating portion 190 is in the projecting position is less than that when the tilt-regulating portion 190 is in the retracting position. That is, the back frame 123 may be prevented from pivoting or may slightly pivot when the tilt-regulating portion 190 is in the projecting position.

The tensile material 111 is fastened to the outer peripheral edge of the shell 110 to close the opening of the shell 110 from front and above. Specifically, the tensile material 111 is fastened along the outer peripheral edges of the seat frame 120 and the back frame 123 together. A portion of the tensile material 111 covering the seat frame 120 forms the seat surface 100*a*. A portion of the tensile material 111 covering the back frame 123 forms a back-supporting surface 100*b*. The tensile material 111 is formed by combining stretchable synthetic resin fibers in a mesh shape. However, the tensile material 111 is not limited to a mesh shape, and cloths, films or the like can be used therefor as long as the tensile material 111 is configured to deform following the pivoting or the like of the backrest 101 relative to the seat 100.

As shown in FIGS. 2, 4 and 5, a pushing mechanism 200 is interposed between the seat frame 120 and the support base 12. The pushing mechanism 200 pushes the seat frame 120 forward. The pushing mechanism 200 includes a first pushing member 201, holding members 202, and second pushing members 203.

The first pushing member 201 is formed of an elastically deformable wire bridging an area between the casing 21 and the spring-accommodating portion 133. Specifically, in the first pushing member 201, in a state where a central portion thereof is supported by the front end portion of the case body 31, two end portions thereof in the left-right direction extend along the inner sides of the forward extending portions 32 upward and outward in the left-right direction as it goes forward. The two end portions of the first pushing member 201 in the left-right direction enter the spring-accommodating portions 133 through the slide-permitting portions 133*a*.

The holding member 202 is accommodated in the spring-accommodating portion 133. The outer end portion of the first pushing member 201 in the left-right direction is connected to the holding member. The holding member 202 holds the first pushing member 201 such that the first pushing member 201 is rotatable around an axis extending in the left-right direction. The rear portion of the spring-accommodating portion 133 is provided with a screw 205 projecting into the spring-accommodating portion 133. The holding member 202 is sandwiched between the screw 205 and the second pushing member 203 in the forward-rearward direction, thereby positioning the holding member 202 in the forward-rearward direction inside the spring-accommodating portion 133.

The second pushing member 203 is, for example, a coil spring. The second pushing member 203 is accommodated in an area inside the spring-accommodating portion 133 positioned in front of the holding member 202. In other words, the first pushing member 201 is positioned rearward by the length of the second pushing member 203 in the forward-rearward direction. The second pushing member 203 is interposed between the front wall of the spring-accommodating portion 133 and the holding member 202 to push the seat frame 120 forward.

(Method of Using Chair 1)

Figure 11:
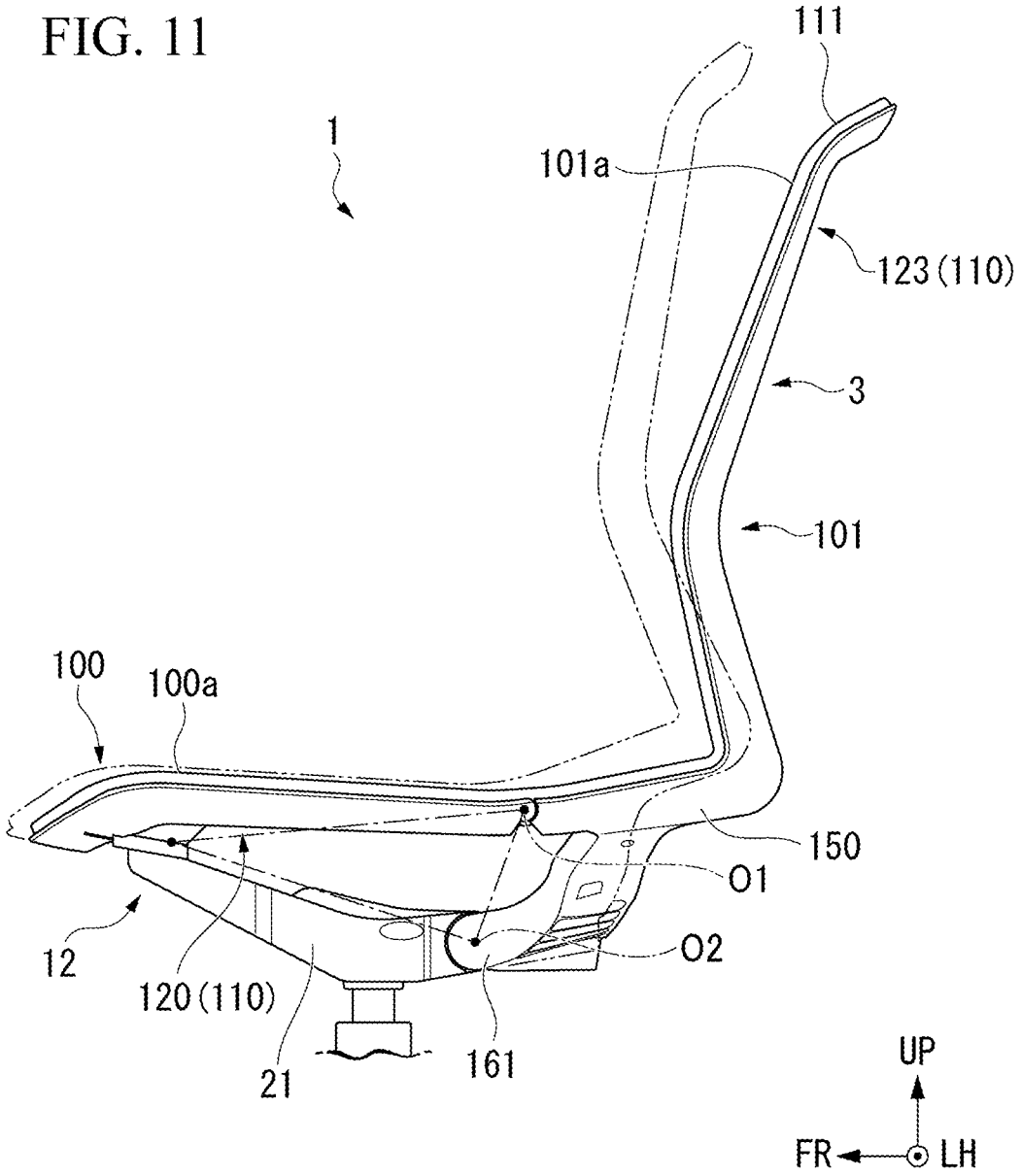
FIG. 11 is a side view showing a reclined state of a backrest in the chair of the embodiment.

Next, as a method of using the chair 1 described above, the operation at reclining the chair body 3 is described. In the following description, the state where the advance/retraction piece 74 is in the retracting position is described as an initial state. FIG. 11 is a side view of the chair 1 showing a reclined state of the backrest 101.

The chair 1 of this embodiment forms a link mechanism with the support base 12 (the casing 21) as a fixed link, the back frame 123 as a pivot link, and the seat frame 120 as a slide link. Specifically, in a state where a seated person seats oneself in the chair body 3, when the seated person leans against the backrest 101, a rearward load acts on the chair body 3 through the backrest 101. Then, as shown in FIG. 11, the backrest 101 pivots rearward around the axis O2 relative to the support base 12. Then, the backrest 101 pivots rearward around the axis O1 relative to the seat 100. Thereby, the seat 100 is pulled rearward as the backrest 101 pivots. At this time, since the seat 100 is configured to be movable in the forward-rearward direction in a state where the movement thereof in the up-down direction is limited by the slider 51, the seat 100 slides rearward relative to the support base 12 as the backrest 101 pivots. Also, since the seat-engaging portion 132 extends downward as it goes rearward, the seat 100 moves downward as it goes rearward. As a result, the backrest 101 is reclined rearward while the entire chair body 3 moves rearward. At the time the backrest 101 is reclined, the pushing members 201 and 203 are elastically deformed as the seat 100 moves rearward. Thereby, the pushing force of the pushing mechanism 200 is increased.

When the seated person straightens oneself up and the load acting on the backrest 101 is released, the seat 100 starts moving forward by the pushing force of the pushing mechanism 200. Accordingly, the backrest 101 pivots forward around the axis O1 relative to the seat 100 and pivots forward around the axis O2 relative to the support base 12. As a result, the chair body 3 returns to its initial state. At this time, the pushing force of the coil spring as the second pushing member 203 is added to the pushing force of the first pushing member 201 made of a wire material, so the first pushing member 201 made of a wire material does not have to be elastically deformed in an excessively large manner. The amount of movement of the seat 100 in the forward-rearward direction is set within a predetermined range, and the first pushing member 201 is positioned rearward by the length of the second pushing member 203 in the forward-rearward direction, so the amount of displacement of the first pushing member 201 in the forward-rearward direction can be reduced by the amount of elastic deformation of the second pushing member 203 in the forward-rearward direction. Therefore, deterioration of the first pushing member 201 over time can be limited.

Next, the operation of the chair 1 in a state where the advance/retraction piece 74 is in the projecting position is described.

In order to move the advance/retraction piece 74 to the projecting position, the operation rod 62 of the tilting adjustment mechanism 24 is rotated. Then, the rotational motion of the operation rod 62 is transmitted to the second arm 72 through the first arm 71 and thus is converted into linear motion of the second arm 72 and the advance/retraction piece 74. Thereby, the advance/retraction piece 74 slides rearward in the slide space Si. As a result, the advance/retraction piece 74 projects rearward from the casing 21 to enter the tilt-regulating portion 190. In this state, when the backrest 101 is to be reclined, the top surface of the tilt-regulating portion 190 contacts the advance/retraction piece 74 from above, thereby limiting the backrest 101 from pivoting.

(Method of Assembling Chair 1)

Figure 12:
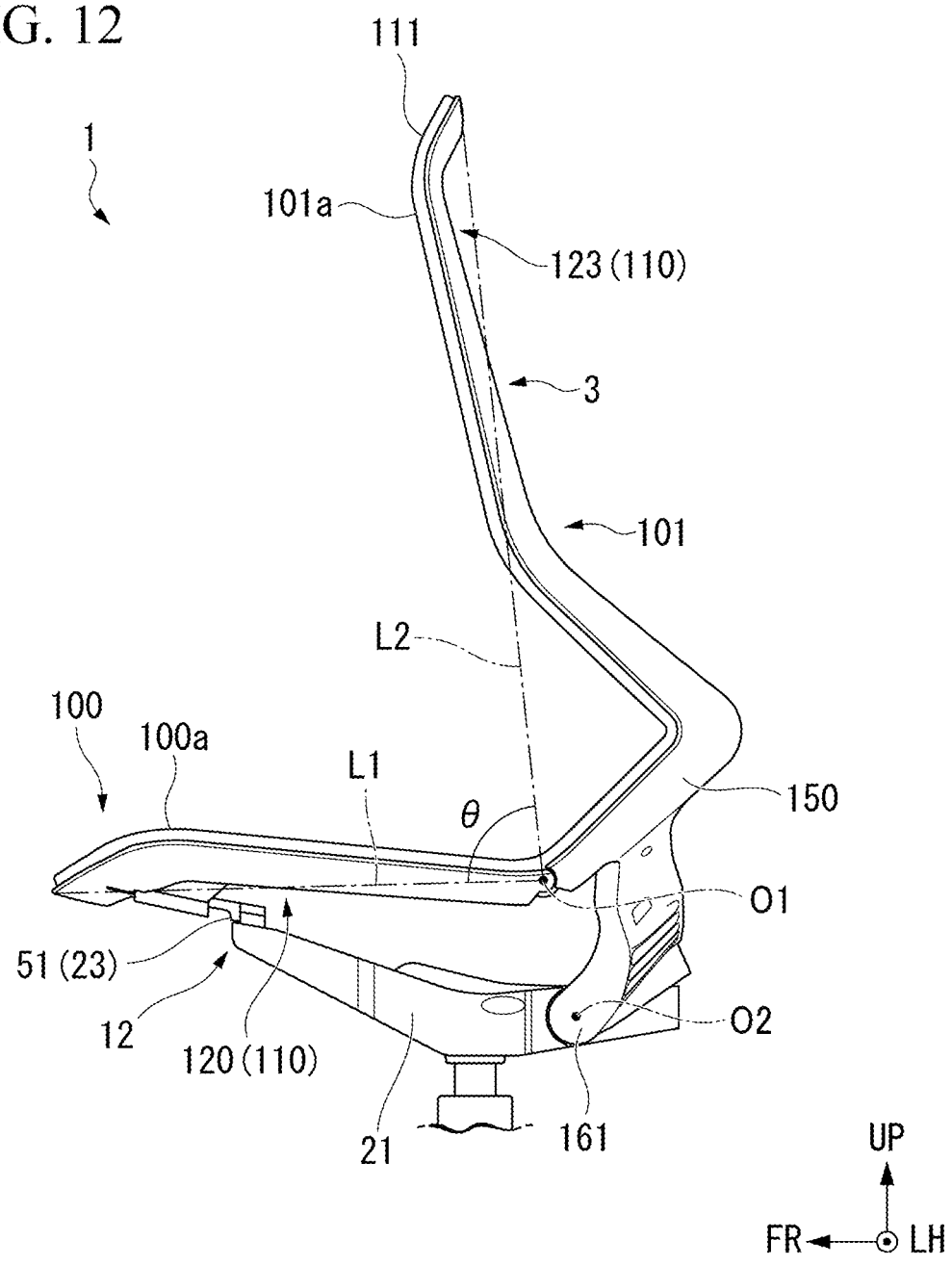
FIG. 12 is a side view of the chair showing a state where the chair body is in the assembly position in the chair of the embodiment.

Next, as a method of assembling the chair 1, a method of attaching the chair body 3 to the support base 12 is described. FIG. 12 is a side view of the chair 1 showing a state where the chair body 3 is in the assembly position.

First, as shown in FIG. 12, in a state where the shell 110 is in the assembly position, the seat frame 120 and the support base 12 are connected together. Specifically, as shown in FIG. 5, the slider 51 is inserted into the seat-engaging portion 132 through the rear end opening 132*a* and the slit opening 132*e* of the seat-engaging portion 132. At this time, the post 58 of the slider 51 is made to enter the slit 132*c*, and the upper wall 59 is made to enter the seat-engaging portion 132.

The second pushing member 203 is inserted into the spring-accommodating portion 133 through the rear end opening of the spring-accommodating portion 133. Then, the holding member 202 is inserted through the rear end opening of the spring-accommodating portion 133 thereinto. At this time, the outer end portion of the first pushing member 201 in the left-right direction enters the slide-permitting portion 133*a*. Thereafter, the screw 205 is attached to the spring-accommodating portion 133, and the tip portion of the screw 205 is made to project into the spring-accommodating portion 133. Thereby, the pushing mechanism 200 is attached into the spring-accommodating portion 133 in a state where the initial pushing force is accumulated in both of the first pushing member 201 and the second pushing member 203.

With the above, the seat frame 120 is attached to the support base 12.

Next, as shown in FIG. 9, the back frame 123 and the support base 12 are connected together. Specifically, the backrest-supporting shaft 52 is made to enter the holder 168 through the insertion opening 168*a* of the holder 168. Thereafter, the back frame 123 is pivoted to the use position. Then, the protrusion 173 enters the retainer 170 to limit the rearward movement of the back frame 123 relative to the backrest-supporting shaft 52.

Next, as shown in FIG. 6, the return stopper 181 is attached to the casing 21. Specifically, the shaft 181*a* of the return stopper 181 is inserted into the insertion hole 33*c* of the rear wall 33*a*, thereby causing the tip portion of the shaft 181*a* to protrude from the rear wall 33*a*. Then, the tip portion of the shaft 181*a* enters the vertical groove 180 of the back frame 123. Thereby, the pivoting of the back frame 123 toward the assembly position is limited. Thereafter, the positioning bolt 185 is attached to the casing 21 to limit the forward movement of the return stopper 181.

Then, the tensile material 111 is attached to the shell 110, and thus the chair body 3 is attached to the support base 12. The assembly method described above may be performed after the tensile material 111 is attached to the shell 110.

(Effects)

In this way, the chair 1 of this embodiment has, in a configuration in which the seat frame 120 and the back frame 123 are assembled to be pivotable around the first axis O1, a configuration in which the support base 12 includes the slider 51 that supports the seat frame 120 movably in the forward-rearward direction, and the backrest-supporting shaft 52 that supports the back frame 123 pivotably around the second axis O2.

According to this configuration, as the backrest 101 pivots around the axis O2 relative to the support base 12, the backrest 101 (the back frame 123) pivots around the axis O1 relative to the seat 100 (the seat frame 120), and the seat 100 slides in the forward-rearward direction relative to the support base 12. Thereby, compared to a configuration in the related art in which the front end portion of the seat is moved up as the backrest pivots rearward, the movement of the seat 100 in the up-down direction as the backrest 101 pivots rearward can be limited. That is, the seat 100 can be smoothly moved in the forward-rearward direction as the backrest 101 pivots, so discomfort that the seated person feels when reclining can be reduced.

The chair 1 of this embodiment is configured to include the coupling member 121 that couples the seat frame 120 and the back frame 123 pivotably around the axis O1.

According to this configuration, by using the coupling member 121 that is a different body from the seat frame 120 and the back frame 123, while the strength of the chair body 3 can be secured, the pivoting amount or the like of the back frame 123 relative to the seat frame 120 can be easily adjusted.

The chair 1 of this embodiment is configured to include the retainer 170 such that when the chair body 3 (the shell 110) is in the use position, the retainer 170 engages with the protrusion 173 in the opening direction of the insertion opening 168*a* to limit the movement of the back frame 123 relative to the support base 12 in the radial direction of the axis O2, and when the chair body 3 is in the assembly position, the retainer 170 is separated from the protrusion 173 to allow the movement of the back frame 123 relative to the support base 12 in the radial direction of the axis O2.

According to this configuration, in a state where the chair body 3 is in the assembly position, when the holder 168 and the backrest-supporting shaft 52 are made to approach or be separated from each other in the radial direction of the axis O2, the backrest-supporting shaft 52 can be attached to and detached from the holder 168 through the insertion opening 168*a*. On the other hand, in a state where the backrest-supporting shaft 52 is accommodated in the holder 168, when the chair body 3 is made to be in the use position, the backrest-supporting shaft 52 can be limited from detaching from the holder 168 through the insertion opening 168*a*. Thereby, even when a configuration is used in which the seat 100 and the backrest 101 are combined together, the assemblability thereof can be improved.

The chair 1 of this embodiment is configured such that the return stopper 181 that engages with the back frame 123 when the chair body 3 is in the use position to limit the back frame 123 from pivoting around the axis O1 to the assembly position is detachably attached to the support base 12.

According to this configuration, after the back frame 123 is attached to the support base 12, the back frame 123 can be limited from returning to the assembly position. Thereby, both assemblability and reliability after assembly can be secured.

The chair 1 of this embodiment is configured such that the seat-engaging portion 132 includes the slit 132*c* opening rearward and extending in the forward-rearward direction, and the slider 51 is supported inside the slit 132*c* to be movable in the forward-rearward direction.

According to this configuration, the slider 51 can be inserted into the slit 132*c* through the rear end opening 132*a* of the seat-engaging portion 132. Thereby, it is possible to improve the assemblability of the seat frame 120 to the support base 12.

(Other Modifications)

Appropriate embodiments of the present disclosure are described above, but the present disclosure is not limited to these embodiments. Additions, omissions, replacements, and other changes can be made for the configuration within the scope of the present disclosure. The present disclosure is not limited by the above description but is limited only by the appended claims.

In the above embodiment, the configuration is described in which the seat frame 120 and the back frame 123 are pivotably coupled through the coupling member 121, but the present disclosure is not limited to this. The coupling member may be configured to include only a pivot that pivotably couples the seat frame 120 and the back frame 123. The coupling member may be configured to be bendable. The chair body 3 may be configured without coupling members. In this case, the seat frame 120 and the back frame 123 may be integrally formed so as to be bendable.

In the above embodiment, the configuration is described which includes the first pushing member 201 made of a wire material and the second pushing member 203 made of a coil spring as the pushing mechanism 200 interposed between the seat frame 120 and the casing 21, but the present disclosure is not limited to this. The pushing mechanism 200 may be configured to include either the first pushing member 201 or the second pushing member 203.

In the above embodiment, the configuration is described in which the retainer 170 opens on the inner surface of the holder 168, but the present disclosure is not limited to this. The retainer 170 may be provided at a different position from the holder 168.

In the above embodiment, the configuration is described in which the block-shaped slider 51 is adopted as the first supporting portion, and the seat frame 120 is provided with the slit 132*c*, but the present disclosure is not limited to this. It is sufficient that the first supporting portion supports the seat frame 120 movably in the forward-rearward direction. In this case, the first supporting portion may be a slit, and the seat frame 120 may be provided with a slider or the like that can move inside the slit. The first supporting portion and the seat frame 120 may be a combination of rails and rollers or the like.

In the above embodiment, the configuration is described in which the backrest-supporting shaft 52 is adopted as the second supporting portion, and the back frame 123 is provided with the holder 168, but the present disclosure is not limited to this. The back frame 123 may be provided with a shaft, and the second supporting portion may be provided with a holder pivotably supported by the shaft.

In the above embodiment, the configuration is described in which the return stopper 181 is provided in the support base 12, but the present disclosure is not limited to this. The return stopper 181 may be configured to be detachably attached to the back frame 123 and to engage with the support base 12.

In the above embodiment, the case is described in which, in the chair body 3 (the shell 110), the seat frame 120 forms the outer shell of the seat 100, and the back frame 123 forms the outer shell of the backrest 101. However, the outer shell of the chair body 3 may be formed of a first member forming the outer shell of part of the seat 100 and a second member forming part of the outer shell of the backrest 101. For example, the seat frame 120 may form the front half of the seat 100, and the back frame 123 may form the rear half of the seat 100 and the backrest 101. In this case, it is preferable that the seat frame 120 include the front end of the chair body 3 and form an area of ½ or more of the total length of the seat 100, and the back frame 123 include the upper end of the chair body 3.

Within the scope of the present disclosure, the components in the above embodiment can be appropriately replaced with well-known components, and the modifications described above may be appropriately combined.

The invention claimed is:

1. A chair, comprising:

a support structure; and a chair body including a first member that extends in a forward-rearward direction and forms at least part of a seat, and a second member that is provided in a rear end of the first member to be pivotable around a first axis extending in a left-right direction, extends upward from the first member, and forms at least part of a backrest, wherein the support structure includes a first supporting portion that supports, in front of the first axis, the first member movably in the forward-rearward direction, and a second supporting portion that supports, below the first axis, the second member pivotably around a second axis extending in the left-right direction, wherein the chair body is configured to be pivotable between a first position and a second position, the first position in which an angle around the first axis between the first member and the second member is a first angle, and the second position in which the angle around the first axis between the first member and the second member is a second angle less than the first angle, the second supporting portion is a shaft member extending along the second axis, and the second member includes a holder including an opening that opens in an intersecting direction intersecting with the second axis and into which the second supporting portion is insertable, and holding the second supporting portion, and a retainer, in which the retainer engages with the support structure in the intersecting direction when the chair body is in the first position to limit the second member from moving in the intersecting direction relative to the support structure, and the retainer is separated from the support structure when the chair body is in the second position to allow the second member to move in the intersecting direction relative to the support structure.

2. The chair according to claim 1, wherein the chair body includes a coupling member that couples the first member and the second member pivotably around the first axis.

3. The chair according to claim 1, wherein either one member of the second member and the support structure is detachably provided with a restraining portion that engages with the other member of the second member and the support structure when the chair body is in the first position to restrain the chair body from pivoting around the first axis toward the second position.

4. The chair according to claim 1, wherein the first member is provided with a slit including another opening that opens in the forward-rearward direction and into which the first supporting portion is insertable, and extending in the forward-rearward direction, and the first supporting portion is configured to be movable in the forward-rearward direction inside the slit.

* * * * *